US005109232A

United States Patent [19]

Monte

[11] Patent Number: 5,109,232

[45] Date of Patent: Apr. 28, 1992

[54] DUAL FREQUENCY ANTENNA FEED WITH APERTURED CHANNEL

[75] Inventor: Thomas D. Monte, Lockport, Ill.

[73] Assignee: Andrew Corporation, Orland Park, Ill.

[21] Appl. No.: 482,201

[22] Filed: Feb. 20, 1990

[51] Int. Cl.[5] ..... H01Q 13/02; H01Q 13/24; H01P 1/16; H01P 1/213

[52] U.S. Cl. ..... 343/785; 343/786; 333/126; 333/135; 333/21 R

[58] Field of Search ..... 333/126, 129, 135, 21 R; 343/786, 785, 776, 773

[56] References Cited

U.S. PATENT DOCUMENTS

| | | | |
|---|---|---|---|
| 3,086,203 | 4/1963 | Hutchinson | 333/21 R X |
| 3,150,333 | 9/1964 | Bowman | 333/125 |
| 3,265,993 | 8/1966 | Davidson et al. | 333/21 R X |
| 3,268,902 | 8/1966 | Turrin | 333/21 R X |
| 3,500,419 | 3/1970 | Leitner et al. | 333/126 X |
| 3,508,217 | 4/1970 | Ware et al. | 333/21 R X |
| 3,594,663 | 7/1971 | Allen | 333/135 X |
| 3,605,101 | 9/1971 | Kolettis | 343/786 X |
| 3,936,775 | 2/1976 | Snyder | 333/21 A X |
| 4,199,764 | 4/1980 | Williams et al. | 343/786 |
| 4,258,366 | 3/1981 | Green | 343/786 |
| 4,356,495 | 10/1982 | Morz | 343/786 |
| 4,365,253 | 12/1982 | Morz | 343/786 |
| 4,380,014 | 4/1983 | Howard | 343/786 |
| 4,414,516 | 11/1983 | Howard | 333/21 A |
| 4,468,672 | 8/1984 | Dragone | 343/783 |
| 4,472,721 | 9/1984 | Morz et al. | 343/786 |
| 4,482,899 | 11/1984 | Dragone | 343/786 |
| 4,491,810 | 1/1985 | Saad | 333/126 |
| 4,498,061 | 2/1985 | Morz et al. | 333/21 A |
| 4,503,379 | 3/1985 | Raiman | 333/21 A |
| 4,504,805 | 3/1985 | Ekelman, Jr. et al. | 333/126 |
| 4,504,836 | 3/1985 | Seavey | 343/761 |
| 4,527,166 | 6/1985 | Luly | 343/840 |
| 4,544,900 | 10/1985 | Howard | 333/21 A |
| 4,554,552 | 11/1985 | Alford et al. | 343/786 |
| 4,578,681 | 3/1986 | Howard | 343/786 |
| 4,636,798 | 1/1987 | Seavey | 343/753 |
| 4,683,475 | 7/1987 | Luly | 343/915 |
| 4,686,491 | 8/1987 | Howard | 333/21 A |
| 4,700,154 | 10/1987 | Schuegraf | 333/125 |
| 4,724,097 | 6/1988 | Krall et al. | 343/719 |
| 4,734,660 | 3/1988 | Lofgren | 333/21 A |
| 4,740,795 | 4/1988 | Seavey | 343/786 |
| 4,743,915 | 5/1988 | Rammos et al. | 343/776 |
| 4,755,828 | 7/1988 | Grim | 343/786 |
| 4,785,266 | 11/1988 | Newham et al. | 333/21 A |
| 4,785,306 | 11/1988 | Adams | 343/786 |
| 4,829,313 | 5/1989 | Taggart | 343/756 |
| 4,845,508 | 7/1989 | Krall et al. | 343/785 |

FOREIGN PATENT DOCUMENTS

| | | |
|---|---|---|
| 1201199 | 2/1986 | Canada . |
| 0284911A1 | 3/1988 | European Pat. Off. . |
| 0285879A1 | 3/1988 | European Pat. Off. . |
| 59-28701 | 2/1984 | Japan . |

OTHER PUBLICATIONS

IEEE Transactions on Antennas and Propagation, May, 1975, pp. 404–407.

IEEE Transactions on Antennas and Propagation, Aug. 1984, pp. 598–603.

(List continued on next page.)

*Primary Examiner*—Eugene R. Laroche
*Assistant Examiner*—Benny T. Lee
*Attorney, Agent, or Firm*—Arnold, White & Durkee

[57] ABSTRACT

A dual band feed arrangement for a microwave antenna provides microwave communication in a lower band and in a substantially widened upper band to provide simultaneous microwave communication for three signals. One signal in the lower band propagates between the outer and inner conductors of a coaxial waveguide in the $TE_{11}$ coaxial mode, and two signals in the upper band propagate in the inner conductor in $TE_{11}$ circular waveguide mode. A combiner, having a conically shaped section with a plurality of irises through its sidewall, is coupled to the coaxial waveguide to provide a transformation from the $TE_{11}$ modes to the $HE_{11}$ waveguide modes for each of the three signals. A dielectric rod extends from within the inner conductor and into the horn antenna for propagating the second signal out of and into the antenna.

23 Claims, 4 Drawing Sheets

OTHER PUBLICATIONS

IEEE Transasctions on Antennas and Propagation, vol. AP-27, No. 6, Nov. 1979, pp. 858-860.

MBB Space Communications & Propulsion Systems Div., Antennas for Ground Application/Program, S/X Band, S-Band Feed, Ground Stations (Address: P.O. Box 80 11 69, 8000 Munich 80, Telephone #(0 89) 60 00-0.

Andrew Corporation, 7.3 M ESA Feed Horn Assembly Plan, Drawing No. 208958, May 12, 1988.

Andrew Corporation, SHX Super High Performance Antenna Accessories, Compact 4-Port Combining Networks, Types #205572, 201759A, and 205136.

DUAL FREQUENCY ANTENNA FEED WITH APERTURED CHANNEL

FIELD OF THE INVENTION

The present invention relates generally to communication systems and, more particularly, to couplers and combiners used in microwave communication systems.

BACKGROUND OF THE INVENTION

Microwave coupling devices ("couplers") are used to join two waveguide structures through which one or more microwave signals propagate. In a typical microwave coupler application, the coupler may be used to link two waveguide structures having different propagation modes. In a more specific coupler application, a combiner-type coupler is often used to "feed" an antenna from a waveguide structure such that the antenna transmits or receives signals in two or more frequency bands. In each instance, the microwave coupler would be designed to provide the appropriate waveguide transition between the respective structures. An improper transition in such microwave couplers can cause an unacceptable VSWR and typically results in significant signal distortion. Signal distortion introduces the propagation of signals in a multitude of undesired higher order modes, often referred to as "overmoding." Such "overmoding" adversely affects both the bandwidth and the quality of the propagating signals.

In the prior art, the magnitude of such higher order modes has been lessened by careful dimensioning of the waveguide to provide a cut-off point beyond which these modes will not operate. Unfortunately, such dimensioning by itself does not accommodate many applications in which the combiner or coupler propagates signals in more than one frequency band.

There are previously known combiner structures that propagate signals in two frequency bands, However, they require costly or elaborate combiner structures to transform the propagation modes from the respective waveguide paths into a common path operating in a signal propagation mode. For example, one such structure includes a tuning choke which is used as part of a dual band junction in which signals from two frequency bands are respectively passed into the outer and inner conductors of a coaxial waveguide. Another type employs a conically shaped cone having a circular waveguide coupled at its base through which a signal from one frequency band passes, and has four openings through its side wall through which a signal from one frequency band, represented by two orthogonal polarizations, passes. The orthogonal polarizations which pass through the side wall are fed respectively from separate hybrid tees with electrically balanced waveguide connecting structures. These structures are not only costly to build, but the two bands that they accommodate are relatively narrow and, therefore, are limited in their signal carrying capacity. Attempts to expand that capacity have resulted in intolerable signal distortion.

Accordingly, there is a need for a coupling structure that overcomes the aforementioned deficiencies.

SUMMARY OF THE INVENTION

In accordance with a preferred embodiment, the present invention provides a coupling arrangement for a microwave application that is capable of accommodating microwave communication in a lower band as well as a substantially widened upper band. The arrangement includes a coaxial waveguide, having an inner and an outer conductor, joined to a microwave element using a combining junction having a narrow end and a wide end. The narrow end is coupled to the inner conductor, and the wide end is disposed between the outer conductor and the microwave element. One signal in the lower band propagates between the outer and inner conductors of the coaxial waveguide section in the $TE_{11}$ coaxial mode, and two signals in the upper band propagate in the inner conductor in the $TE_{11}$ circular waveguide mode.

Preferably, the combining junction includes a conically shaped section with a plurality of irises through its sidewall to provide a transformation from the $TE_{11}$ modes in the coaxial waveguide section to the $HE_{11}$ waveguide modes for each of the three signals. A dielectric rod, extending from within the inner conductor and into a horn antenna, is preferably used for propagating the second signal between the microwave element and the inner conductor of the coaxial waveguide.

BRIEF DESCRIPTION OF THE DRAWINGS

Other objects and advantages of the present invention will become apparent upon reading the following detailed description and upon reference to the drawings in which.

Figure 1A:
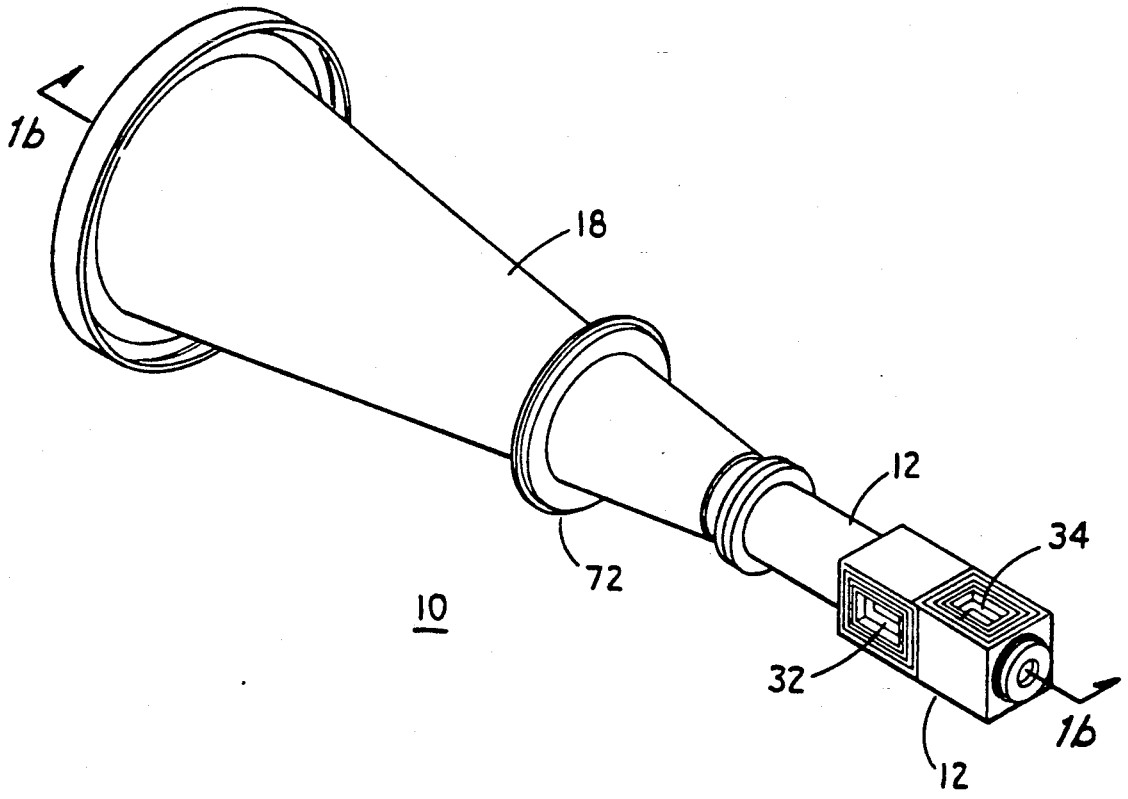
FIG. 1*a* illustrates a perspective view of a feed system for a microwave antenna, according to the present invention.

While the invention is susceptible to various modifications and alternative forms, specific embodiments thereof have been shown by way of example in the drawings and will herein be described in detail. It should be understood, however, that it is not intended to limit the invention to the particular forms disclosed. On the contrary, the intention is to cover all modifications, equivalents, and alternatives falling within the spirit and scope of the invention as defined by the appended claims.

DETAILED DESCRIPTION OF THE PREFERRED EMBODIMENTS

The present invention may be advantageously used for a wide variety of signal coupling applications involving microwave communication. The present invention has been found to be particularly useful, however, as a feed system for an earth station antenna in a microwave earth-satellite communication system. It is in this context that the present invention will be discussed.

Figure 1B:
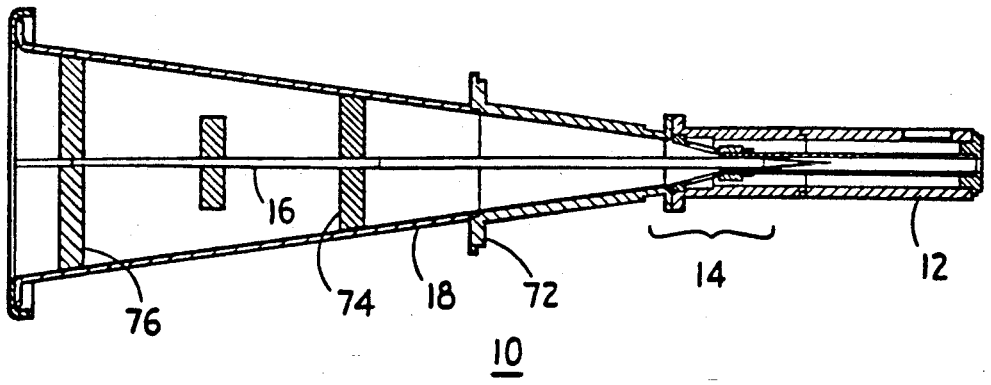
FIG. 1*b* illustrates a cross-sectional view of the feed system of FIG. 1*a*.

FIGS. 1*a* and 1*b* illustrate such a feed system 10 in accordance with the present invention. The feed system 10 includes certain structural similarities to a previously known feed system; namely, Part No. 208958, available from Andrew, Corp., Orland Park, Ill. Each feed system may be implemented using the same horn antenna, and each system includes a coaxial waveguide and dielectric rod which are similar. Certain structural differences between the two feed systems, however, provide a significantly different operation. For example, unlike the feed system 10, the above mentioned prior art feed system is limited to simultaneous reception for signals in two relatively narrow frequency bands, between 3.7 and 4.2 GHz. (in the C-band) and between 11.7 and 12.2 GHz. (in the Ku-band). Surprisingly, the feed system 10 illustrated in FIGS. 1*a* and 1*b* provide a significant improvement in operation over that prior art system by expanding the Ku-band, for example, between 10.95 and 14.5 GHz.

This expansion provides a significant increase in communication capacity. The feed system 10 illustrated in FIGS. 1*a* and 1*b* (as used in satellite communication system) are capable of receiving signals in the C-band, as previously defined, and in the Ku-band between 10.95 and 12.75 GHz., and of transmitting signals in the Ku-band between 14.0 and 14.5 Ghz. This signal transmission capability is significant in itself. Although microwave frequency bandwidths in satellite communication are typically 0.5 GHz., providing the capability to receive signals between 10.95 and 12.75 GHz. is also advantageous because it ensures reception in any of four commercially-used bandwidths, each defined within this range.

This improvement and the overall operation of the feed system 10 is realized using a relatively inexpensive and elaborate structure which includes a C-band coaxial waveguide 12, a dual band junction 14, a dielectric rod 16 (FIG 1*b*) and and a horn antenna 18. The coaxial waveguide is used to carry signals to and from the antenna's radiating elements: the dielectric rod 16 and the horn antenna 18. The dual band junction 14 provides the necessary transition between the signals propagating in the coaxial waveguide 12 and their reception or transmission at the horn antenna 18 and the dielectric rod 16.

Figure 2A:
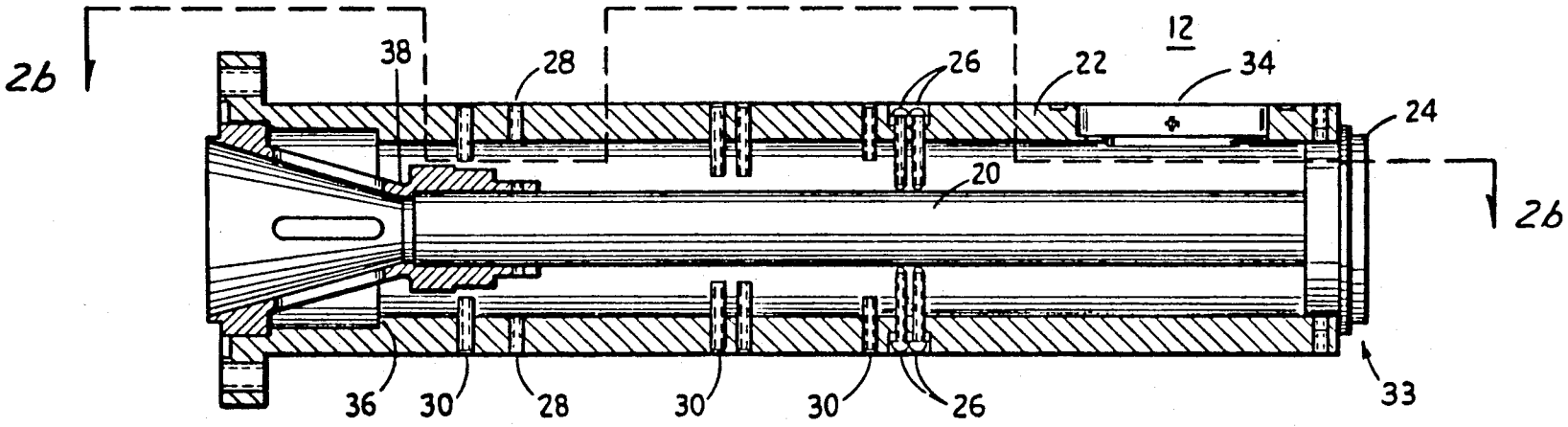
FIG. 2*a* illustrates a cross-sectional expanded view of a coaxial waveguide section which is part of the feed system of FIGS. 1*a* and 1*b*.
Figure 2B:
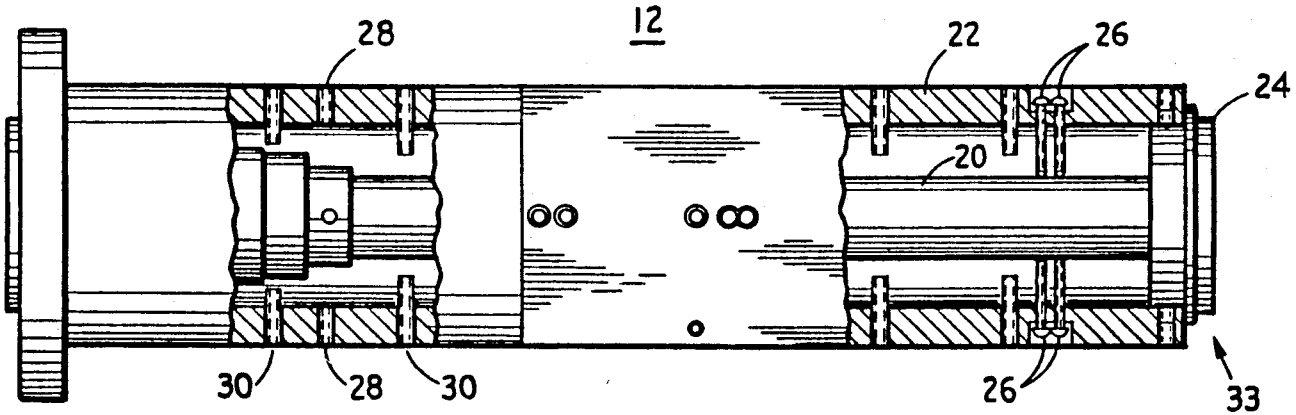
FIG. 2*b* illustrates a cross-sectional view of the coaxial waveguide section along line 2*b*—2*b* in FIG. 2*a*.

More specifically, the coaxial waveguide 12, which is illustrated in expanded form in FIGS. 2*a* and 2*b*, is constructed to propagate transmit and receive signals in the Ku-band within its inner conductor 20 and to propagate a receive signal in the C-band between the inner conductor 20 and the outer conductor 22 of the coaxial waveguide 12. The inner conductor 20 of the coaxial waveguide 12 is supported by the outer conductor 22 in four areas. At end 33, the inner conductor 22 is supported by a metal coupler 24. The center of the inner conductor 20 is supported by metallic support screws 26 on opposing sides of the outer conductor 22 near each port 32 (FIGS. 1*a*, 2*a*) and 34 (FIG. 1*a*), and the end of the inner conductor 20 nearest the horn antenna 18 is conveniently supported by a junction channel 38 in the dual band junction 14. The support provided at the dual band junction is important, because it alleviates the cost and labor which would otherwise be required using additional dedicated supports.

Within the inner conductor 20, the signals propagate in the $TE_{11}$ circular waveguide mode, and between the conductors 20 and 22, the signals propagate in the $TE_{11}$ coaxial waveguide mode. Within the horn antenna 18, the signals propagate in the $HE_{11}$ mode. A primary function of the dual band junction 18, is therefore, to provide a substantially continuous transformation between the $TE_{11}$ circular and coaxial modes and the $HE_{11}$ mode. The undesired but dominate TEM mode within the coaxial waveguide 12 is limited to insubstantial levels using small excitation irises 28 and tuning screws 30, the latter of which are preferably symmetrically located about the outer conductor 22. The tuning screws 30 may be placed ahead of or behind the dual band junction 14 as desired to C-band return loss. Inside the coaxial waveguide 12 these symmetrical tuning elements 28 and 30 are placed on both the inner and outer conductors 20 and 22. The next undesirable high order mode is the $TE_{21}$ coaxial mode with a cutoff frequency at 5.05 GHz.

The Ku- and C-band signals are introduced into the waveguide using conventional microwave devices. The signals in the Ku-band may be coupled to and from the coaxial waveguide 12 using a conventional Ku-band four-port waveguide combiner, for example, Andrew Model No. 208277, attached at one end 33 of the feed system 10. The signals in the C-band may be coupled from the feed system 10 at a front port 32 (FIG. 2*b*) and at a back port 34 (FIG. 2*a*), both of which are situated through the outer conductor 22 of the coaxial waveguide 12. The front port 32 is used to couple signals having one of two orthogonal polarizations from the coaxial waveguide 12, and the back port 34 is used to couple signals having the other of the two orthogonal polarizations from the coaxial waveguide 12. This coupling implementation for C-band receive signals is substantially the same as the prior art structure defined by Andrew Corp. Part No. 208958.

The inside surface of the outer conductor 22 is continuous from the end 33 until it is stepped-out at a point 36 (FIGS. 2*a*, 3*a*) near the dual band junction 14 to provide an appropriate impedance match for the C-band signals.

Figure 3A:
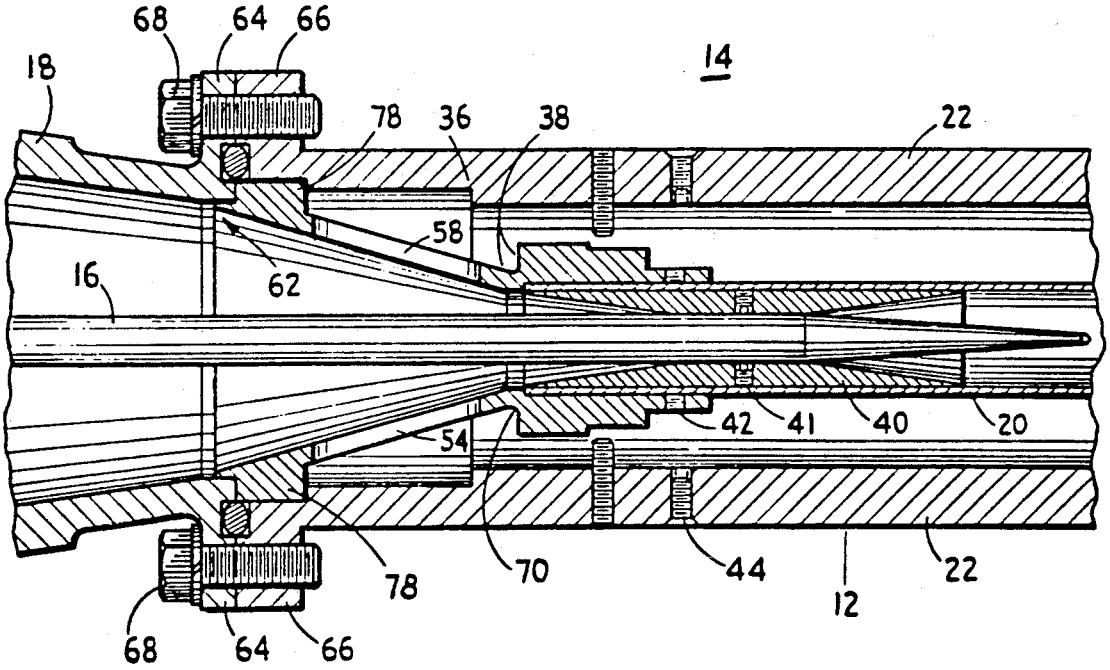
FIG. 3*a* illustrates a cross-sectional expanded view of a dual band junction which is part of the feed system of FIGS. 1*a* and 1*b*.

The dual band junction 14, which is illustrated in exploded form in FIG. 3*a*, is another important feature of the present invention. The primary elements in this area of the feed system 10 include the junction channel 38, a rod support 40 and the dielectric rod 16. Preferably, the junction channel 38 and the rod support 40 are metallic, e.g., aluminum, and the dielectric rod 18 is preferably made of quartz. These elements are designed to couple the signals between the coaxial waveguide 12 and the horn antenna 18. The dielectric rod 16 extends from the horn antenna 18, through the junction channel 38 and partly into the inner conductor 20 of the coaxial waveguide 12. At the inner conductor 20 of the coaxial waveguide 12, the transmit and receive signals in the Ku-band are launched into and from the dielectric rod 16.

The rod support 40, located within the inner conductor 20, provides both mechanical and electrical functions. Mechanically, the rod support 40 is used to secure the dielectric rod 16 in the center of the inner conductor 20. This is accomplished by dimensioning the rod support 40 such that a portion of rod support's inner surface makes contact with the outer surface of the dielectric rod 16. Metal screws 41 include a dielectric ball, preferably made of Teflon, to contact the dielectric rod 16 so that it slidably secures the rod 16 within the rod support 40, while providing an adequate discrimination for the orthogonal polarizations. Metal screws 42 may be used in the side wall of the junction channel 38 to secure the junction channel 38 to the inner conductor 20. Removable metal plugs 44, which are located in the outer conductor 22, are used to provide access to the dielectric screws 42 in the rod support 40.

Figure 3B:
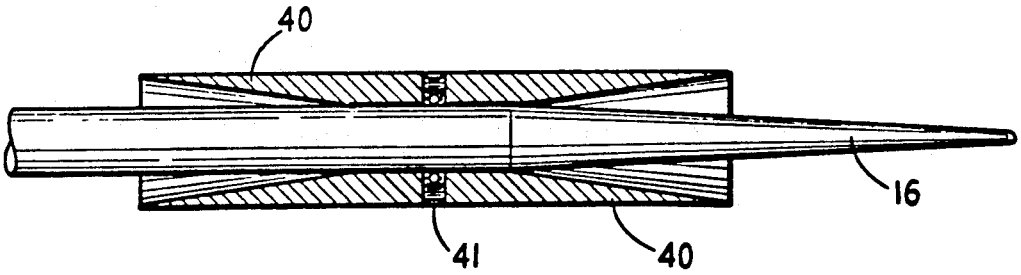
FIG. 3*b* illustrates a cross-sectional expanded view of a rod support and a dielectric rod used in the dual band junction of the feed system.

With regard to its electrical function, the rod support 40 includes a tapered inner surface at both ends so that the Ku-band signals experience negligible reflection as they propagate between the rod 16 and the inner conductor 20. For example, the rod support 40 may flare at an 8 degree half angle off its center axis at both ends. The dielectric rod 16 is also tapered, as illustrated in FIGS. 3*a* and 3*b*, to insure that the Ku-band signals propagating from the inner conductor 20 of the coaxial waveguide 12 are in the dominate $TE_{11}$ mode beginning at the point of contact between the rod 16 and the rod support 40. This contact region comprises a dielectric (quartz) loaded waveguide which is dominate moded from 10.95 through 11.79 GHz., where $TM_{01}$ mode starts to propagate. However, symmetry is kept throughout, and the $TM_{01}$ mode level is negligible. This symmetry also prevents the next high order mode, $TE_{21}$, having a cut-off frequency of 14.97 GHz., from propagating. It is noted that the highest frequency of operation is limited by generation of the undesirable $TM_{11}$ mode which has a cut-off frequency of 18.78 GHz.

Figure 4A:
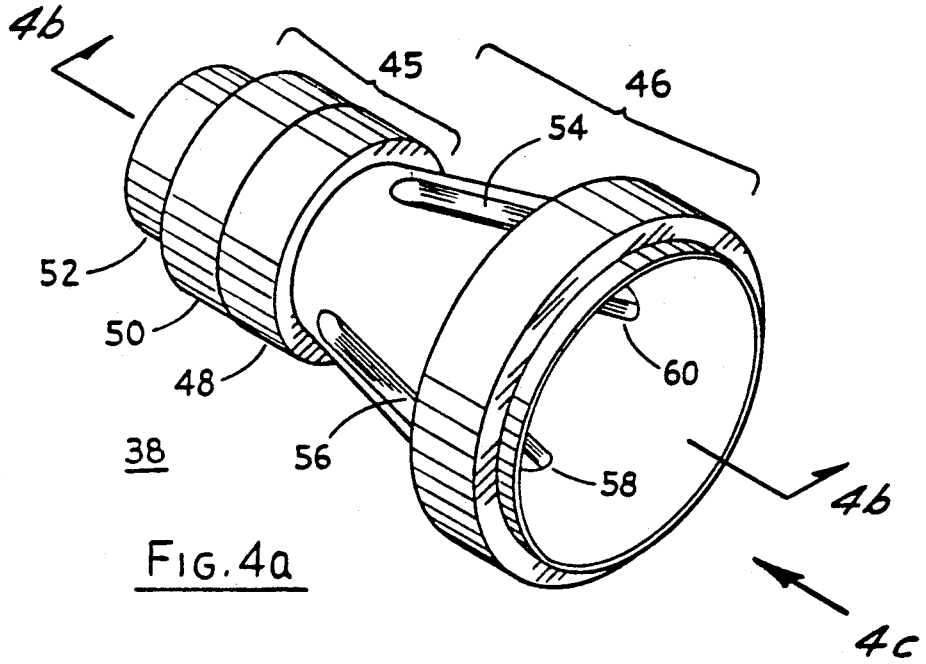
FIG. 4*a* illustrates a perspective view of a junction channel used in the feed system of FIGS. 1*a* and 1*b*.
Figure 4B:
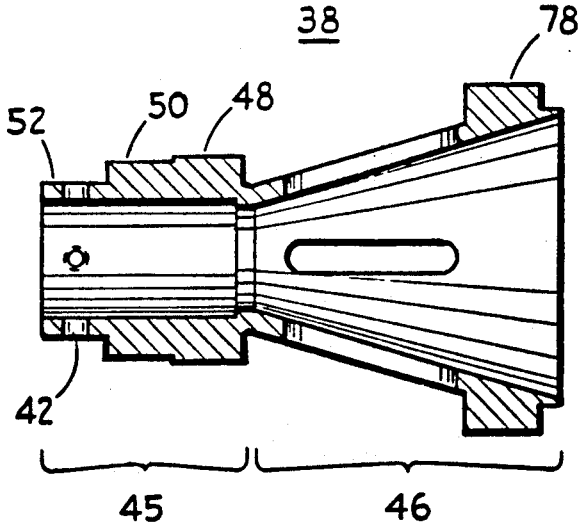
FIG. 4*b* illustrates a cross-sectional view of junction channel.

The junction channel 38, which is best illustrated in FIGS. 3*a* and 4*a*–4*c*, includes a ring section 45 and a conically shaped channel 46. The ring section 45 includes a smooth inner surface having a constant diameter which fits over the end of the inner conductor of the coaxial waveguide 12. The outer surface of the ring section includes three tiers 48, 50 and 52. These tiers are used for impedance matching as the C-band signals propagate between the coaxial waveguide 12 and the horn antenna 18 (FIGS. 4*a*–4*b*).

Figure 4C:
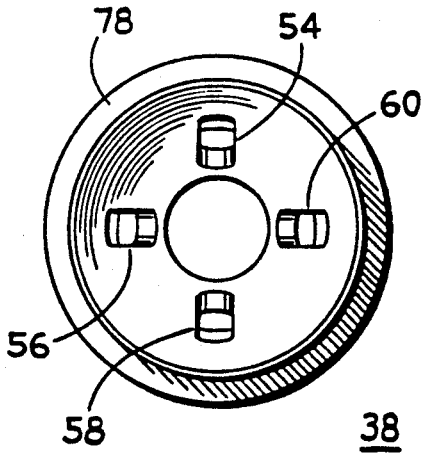
FIG. 4*c* illustrates an end view of the junction channel 38 along line 4*b*—4*b* in FIG. 4*b*.

In order for the C-band signals to pass from the horn antenna 18 to the coaxial waveguide 12 without significant distortion or reflection, the conically shaped channel 46 includes four irises 54, 56, 58 and 60 about its side wall at 90 degree intervals, in a symmetrical and uniform relationship about the side wall as depicted in FIGS. 4*a*, 4*c*. It has been discovered that the irises 54, 56, 58 and 60 should be in the shape of elongated slots, having their respective lengths running in the same direction as the propagation of the C-band signals. Although not necessary, the irises 54, 56, 58 and 60 are preferably aligned with the ports 32 and 34 in the outer conductor 22 such that each pair of opposing irises passes one of the two orthogonal polarizations of the C-band signal to the coaxial waveguide 12. This permits passage of the C-band signals with minimal signal reflection.

As illustrated in FIG. 3*a* wide end 62 of the conically shaped channel 46 includes a rim 78 protruding therefrom, which is secured between flanges 64 and 66 extending from the horn antenna 18 and the outer conductor 22 of the coaxial waveguide 12, respectively. The flanges 64 and 66 are also used to engage bolts 68 to interlock the horn antenna 18 with the coaxial waveguide 12.

The conically shaped channel 46 also provides the surprising result of widening the Ku-band to allow both the receive and transmit signals to propagate through the feed system 10. This is accomplished by arranging the conically shaped channel 46 to directly meet the ring section 45 at its narrow end 70 (FIG. 3*a*) and to directly meet the ring section 45 and the outer conductor 22 at its wide end 62. This arrangement ensures that the conically shaped channel 46 properly guides the propagating energy between the horn antenna 18 and the inner conductor 20 of the coaxial waveguide 12 while shielding the Ku-band energy from the C-band coaxial waveguide 12; thus, suppressing higher order mode generation and cross polarization levels at the Ku-bands. Experimentation with other arrangements has resulted in substantial Ku-band energy leaking into the coaxial waveguide 12 and reradiating within the feed system, causing overmoding and, thus, signal distortion.

The dielectric rod diameter is kept constant throughout the dual band junction 14 to minimize Ku-band radiation. The metallic wall of the conically shaped channel 46 extends from the rod 16 in a gradual fashion with a linear taper having a half angle of approximately 16°. The 16° taper was chosen to fit the four symmetrical coupling irises 54, 56, 58 and 60 operating at the C-band wavelengths in a compact configuration. The irises 54, 56, 58 and 60 in the conically shaped channel 46 do not disturb the Ku-band transformation from the TE11 circular mode to the dielectric circular waveguide operating in the $HE_{11}$ mode. The quartz dielectric constant is approximately 3.67. This construction achieves the desired transformation with a minimal reflection.

Once launched into the dielectric rod 16 from inner conductor 20 of the coaxial waveguide 12, the Ku-band transmit signals are carried completely within rod 16 until the rod begins to taper in the horn antenna 18. When these signals encounter the tapering of the rod, they begin to move to the outside of the rod. For example, below mounting flanges 72 on the outside of the horn antenna 18 (FIGS. 1*a* and 1*b*), close to 100 percent of the propagating energy is inside the rod 16. At foam rod supports 74 and 76, about 85 percent and 20 percent, respectively, of the propagating energy is inside the rod 16. By the time the energy is at the end of the rod, it is almost entirely along the outside of the rod. The Ku-band transmit signals radiate from the tapered end of the rod 16 near the aperture of the horn antenna.

The receive signals in the Ku-band that are projected into the feed system 10 are collected into the dielectric rod 16 opposite the manner in which the Ku-band transmit signals are launched.

A desirable feature of this design is that the position of the Ku-band phase center is independently adjustable from the C-band phase center by displacing the rod tip externally or internally to the C-band horn aperture. No changes in the C-band primary pattern occur when the rod tip position is varied.

As the radiating dielectric rod position is moved into the horn, a slight degradation of the Ku-band may be noticed due to the diffraction of incident energy off the perimeter of the horn aperture. Pulling the rod tip in too far could generate a multitude of modes across the aperture. The Ku-band pattern mode purity can be improved by placing a microwave absorber ring around the inside perimeter of the horn aperture.

For the best overall C-band performance, a corrugated horn antenna, that is specifically designed for the 7.3 m ESA, may be used. Other horns, e.g., a smooth wall conical horn and a dual mode horn, provide nonoptimal symmetrical patterns, spillover and cross polarization. Each of these various horns should have its metallic walls far removed from the dielectric rod, so that there is no effect on the Ku-band signal performance.

EXEMPLARY DIMENSIONS

A preferred feed system, which is designed as part of the previously described system for reception of C-band signals between 3.7 and 4.2 GHz. and for reception and transmission of Ku-band signals between 10.95 and 14.5 GHz. is described in structural terms below.

In the junction channel 38, the ring section 45 is 1.50 inches in length and the conically shaped section 46 is 2.41 inches in length, both along the junction channel's center axis. The inside diameter of the ring section 45 which surrounds the inner conductor 20 is 0.873 inch, and the inside diameter at which the conically shaped channel 38 begins is 0.800 inch. The three tiers 48, 50 and 52 include the following outside diameters: 1.476, 1.440 and 1.125 inches, respectively. The conically shaped channel 46 flares at a 16 degree half angle, the irises 54, 56, 58 and 60 in its sidewall(s) are 1.310 inches in length along the junction channel's center axis, 0.250 inch in width and include rounded corners. The irises 54–60 begin 0.327 inch, as measured along the junction channel's center axis, from the edge of the ring section 45. The rim 78 begins 0.066 inch from the end of the irises 54, 56, 58 and 60, also as measured along the center axis of the junction channel.

The quartz dielectric rod 16 has a length of 36.5 inches, its diameter within the rod support 40 is 0.4 inch, its diameter at its end within the inner conductor 20 tapers sharply for 3.0 inches to an end diameter of 0.03 inch, and its diameter within the horn antenna 18 tapers gradually for 16.25 inches to an end diameter of 0.162 inches.

The horn antenna 18 (and its associated mounting equipment), which may be implemented as in the previously described prior art device by Andrew Corp., flares at an 8 degree half-angle off its center axis.

While the invention has been particularly shown and described with reference to one embodiment and one application, it will be recognized by those skilled in the art that modifications and changes may be made. For example, the system does not require the dielectric rod and rod support in which case the horn antenna would propagate signals in the $TE_{11}$ circular waveguide mode, and the horn antenna may be replaced with a conventional circular waveguide. Further, the angles which define the flares of the horn antenna and the conically shaped channel may be varied without substantial degradation to the operation of the system. These and various types of other modifications may be made to the present invention described above without departing from its spirit and scope which is set forth in the following claims.

What is claimed is:

1. A microwave coupling arrangement, comprising:

a coaxial waveguide section having an outer conductor and an inner conductor for propagating first and second microwave signals, respectively, wherein the outer and inner conductors define a common region therebetween;

junction means, disposed between a microwave element and the coaxial waveguide, including a channelled section defined by at least one side wall and two ends, one of said two ends having a narrow aperture-defining perimeter coupled to the inner conductor, the other of said two ends having a wide aperture-defining perimeter coupled to the outer conductor and to the microwave element, and the side wall, which is coupled between the inner conductor and the microwave element, including a plurality of irises therethrough, wherein the first microwave signal propagates through the irises between the microwave element and the common region of the coaxial waveguide section and the second microwave signal propagates through the narrow aperture-defining perimeter.

2. A microwave coupling arrangement, according to claim 1, wherein the microwave element includes a horn antenna coupled to the channelled section so as to propagate the first and second microwave signals therethrough.

3. A microwave coupling arrangement, according to claim 2, wherein the microwave element further includes a dielectric rod surrounded, at least in part, by the horn antenna.

4. A microwave coupling arrangement, according to claim 3, wherein the junction means includes means supporting the dielectric rod which is arranged to couple signals between the dielectric rod and the inner conductor of the coaxial waveguide section.

5. A microwave coupling arrangement, according to claim 1, wherein the junction means includes a ring section coupled to the narrow aperture-defining perimeter of the channelled section.

6. A microwave coupling arrangement, according to claim 1, wherein the channelled section is conically shaped.

7. A coupling arrangement for coupling microwave signals between a coaxial waveguide section and a horn antenna, wherein the coaxial waveguide section includes a common region between inner and outer conductors for propagating a first signal in a first frequency band and the inner conductor acts as a circular waveguide for propagating at least a second signal in a second frequency band, the coupling arrangement comprising:

a conically shaped section defined at least in part by a narrow aperture-defining perimeter and a wide aperture-defining perimeter with a channel therethrough, and a side wall, between the wide and narrow aperture-defining perimeters, with a plurality of irises therethrough, wherein the wide aperture-defining perimeter is coupled to the outer conductor of the coaxial waveguide section and to the horn antenna and the narrow aperture-defining perimeter is coupled to the inner conductor of the coaxial waveguide section;

a dielectric rod situated through the conically shaped section and into the horn antenna for propagating the second signal between the inner conductor of the coaxial waveguide section and an atmosphere adjacent the horn antenna;

wherein the propagation path for the first signal is defined by the common region of the coaxial waveguide section, the irises, the channel and the wide aperture-defining perimeter of the conically shaped section and the horn antenna, and the propagation path for the second signal is defined by the inner conductor of the coaxial waveguide section, and the dielectric rod through the channel of the conically shaped section and into the horn antenna.

8. A coupling arrangement, according to claim 7, wherein the irises are located at about 90 degree intervals about the side wall of the conically shaped section.

9. A coupling arrangement, according to claim 8, wherein the irises are elongated slots having lengths that are situated along a direction in which the first signal propagates.

10. A coupling arrangement, according to claim 7, further including a ring section, coupled to and located between the inner conductor of the coaxial waveguide section and the narrow aperture-defining perimeter of the conically shaped section, through which the dielectric rod is located and the second signal propagates.

11. A coupling arrangement, according to claim 10, wherein the dielectric rod includes a first end and second end, both of which are tapered.

12. A coupling arrangement, according to claim 7, wherein the dielectric rod includes quartz.

13. A coupling arrangement, according to claim 7, wherein the first signal propagates within the coaxial waveguide section in the $TE_{11}$ coaxial waveguide mode, the second signal propagates in the inner conductor of the coaxial waveguide section in the $TE_{11}$ circular mode, and the antenna horn propagates both the first signal and the second signal in the $HE_{11}$ mode.

14. A coupling arrangement, according to claim 13, wherein the conically shaped section includes an inner surface of the side wall which provides a substantially continuous transformation of the $TE_{11}$ circular to $HE_{11}$ waveguide modes for the second signal.

15. A waveguide coupling arrangement for propagating a first signal in a first frequency band and at least one second signal in a second frequency band, comprising:

a waveguide section including propagation means for propagating the first signal in a $TE_{11}$ coaxial mode in a common region therein and for propagating the second signal in a $TE_{11}$ circular waveguide mode in another region therein;

a microwave element for providing $HE_{11}$ waveguide mode operation for the first and second signals; and junction means, coupled to and disposed between the microwave element and the waveguide section, including elongated channel means for providing a substantially continuous transformation between the $TE_{11}$ circular and $HE_{11}$ waveguide modes for the second signal and wherein the elongated channel means has a side wall with a plurality of irises therethrough for providing a propagation path for the first signal between the common region and the microwave element and for transforming the first signal between the $TE_{11}$ coaxial and $HE_{11}$ waveguide modes.

16. A waveguide coupling arrangement, according to claim 15, wherein the waveguide section is a coaxial waveguide section having inner and outer conductors and the elongated channel means includes a tapered channelled section, formed at least in part by the side wall, having a narrow aperture-defining perimeter coupled to the inner conductor, and a wide aperture-defining perimeter coupled to the outer conductor and to the microwave element.

17. A microwave coupling arrangement, according to claim 16, wherein the junction means includes a dielectric rod extending from at least the inner conductor into the microwave element for propagating the second signal.

18. A waveguide coupling arrangement for propagating a first signal in a first frequency band and at least one second signal in a second frequency band, comprising:

a waveguide section including propagation means for propagating the first signal in a common region therein the $TE_{11}$ coaxial mode and for propagating the second signal in the $TE_{11}$ circular waveguide mode in another region therein;

a microwave element for providing $TE_{11}$ circular waveguide mode operation for the first and second signal; and junction means, coupled to and disposed between the microwave element and the waveguide section, including a conically shaped section having a side wall with a plurality of irises therethrough for providing a propagation path for the first signal between the common region and the microwave element and for providing a transformation between the $TE_{11}$ coaxial and $TE_{11}$ circular waveguide modes for the first signal.

19. A waveguide coupling arrangement, according to claim 18, wherein the irises in the conically shaped section are located at about 90 degree intervals about the side wall.

20. A dual band feed system for a microwave antenna comprising:

a coaxial waveguide section having an inner and an outer conductor and including a first port for providing a propagation path for a first signal in a first frequency band, a second port for providing a propagation path for second and third signals in a second frequency band, wherein the first signal propagates in a common region between the outer and inner conductors in a $TE_{11}$ coaxial mode and the second and third signals each propagate in the inner conductor in a $TE_{11}$ circular waveguide mode;

a combining junction comprising:

a conically shaped section having a narrow aperture-defining perimeter and a wide aperture-defining perimeter and with a channel therethrough, and a side wall, at least partly defining the conical shape, with a plurality of irises therethrough to provide a path for the first signal from the common region to the microwave antenna and to provide a transformation between the $TE_{11}$ coaxial mode and $HE_{11}$ waveguide mode for the first signal, wherein the conical shape provides a continual transformation of the $TE_{11}$ circular waveguide mode to $HE_{11}$ waveguide mode for the second signal, a ring section, coupled between the inner conductor of the coaxial waveguide section and the narrow aperture-defining perimeter of the conically shaped section, through which the second signal propagates;

wherein the wide aperture-defining perimeter is coupled to the outer conductor of the coaxial waveguide section and to the antenna; and a dielectric rod extending from within the inner conductor, through the ring and the conically shaped sections of the combining junction and into the horn antenna for propagating the second signal.

21. A dual band feed system, according to claim 20, wherein the first band is in the C-band spectrum and the second band is in the Ku-band spectrum.

22. A dual band feed system, according to claim 21, wherein the second band has a bandwidth which is substantially narrower than a bandwidth of the first band.

23. A dual band feed system, according to claim 20, wherein the first band is used for receiving signals in the C-band and the second band is used for transmitting and receiving signals in the Ku-band.

* * * * *